US005813821A

United States Patent [19]

Braud

[11] Patent Number: 5,813,821

[45] Date of Patent: Sep. 29, 1998

[54] MOTORIZED LIFT TRUCK ADAPTED TO BE LOADED ON THE REAR OF A CARRYING VEHICLE

[75] Inventor: Marcel Claude Braud, Champtoceaux, France

[73] Assignee: Manitou BF, Ancenis, France

[21] Appl. No.: 528,300

[22] Filed: Sep. 14, 1995

[30] Foreign Application Priority Data

| | | | |
|---|---|---|---|
| Sep. 14, 1994 | [FR] | France | 94 10953 |
| Jan. 4, 1995 | [FR] | France | 95 00033 |

[51] Int. Cl.[6] ..... B66F 9/00

[52] U.S. Cl. ..... 414/667; 414/664; 414/685; 414/705; 414/708

[58] Field of Search ..... 414/663, 664, 414/667, 668, 671, 685, 686, 705, 708, 547, 549

[56] References Cited

U.S. PATENT DOCUMENTS

| | | | |
|---|---|---|---|
| 2,731,162 | 1/1956 | Walstrom | 414/708 |
| 3,243,053 | 3/1966 | Hanser et al. . | |
| 3,407,947 | 10/1968 | Valla | 414/708 |
| 3,688,929 | 9/1972 | McIntrye | 414/705 X |
| 3,754,673 | 8/1973 | Barda et al. | 414/667 |
| 3,836,025 | 9/1974 | Olson et al. | 414/547 |
| 4,046,346 | 9/1977 | Iijima et al. | 248/298 |
| 4,688,982 | 8/1987 | Smart | 414/667 |
| 4,718,814 | 1/1988 | Addleman | 414/705 |
| 4,826,474 | 5/1989 | Holmes | 414/699 |
| 4,848,010 | 7/1989 | Zimmerman | 414/705 X |
| 4,964,778 | 10/1990 | Muto et al. | 414/708 X |
| 5,113,969 | 5/1992 | Drolet et al. | 182/2 |

FOREIGN PATENT DOCUMENTS

| | | | |
|---|---|---|---|
| 0 325 064 | 7/1989 | European Pat. Off. . | |
| 0 504 527 | 9/1992 | European Pat. Off. . | |
| 2 298 507 | 8/1976 | France . | |
| 2298454 | 8/1976 | France . | |
| 2 387 185 | 11/1978 | France . | |
| 2 402 704 | 8/1974 | Germany . | |
| 2739537 | 3/1978 | Germany | 414/705 |
| 1 525 923 | 9/1978 | United Kingdom . | |
| WO 82/01363 | 4/1982 | WIPO . | |

*Primary Examiner*—Stephen T. Gordon
*Attorney, Agent, or Firm*—Young & Thompson

[57] ABSTRACT

A motorized lift truck, with a telescopic arm (9), comprising a chassis (1) mounted on a plurality of wheels of which at least one (7) is power driven. The chassis (1) carries a motor propulsion group (3), a cab (2) and lifting structure (4) disposed between the motor propulsion group (3) and the cab (2). The lifting structure (4) is the telescopic arm (9) mounted pivotably about a substantially horizontal axle (10). The assembly of the lifting structure (4) comprising the telescopic arm (9) is displaceable transversely, so as to permit precise adjustment over a predetermined distance (d) of the position of the lifting structure (4) so as to engage the load. The truck is adapted to be loaded up on the rear of a carrying vehicle and comprises a chassis (1) having a U shape.

12 Claims, 8 Drawing Sheets

MOTORIZED LIFT TRUCK ADAPTED TO BE LOADED ON THE REAR OF A CARRYING VEHICLE

The invention relates to a motorized lift truck, particularly of the type adapted to be loaded on the rear of a carrying vehicle.

There are known carriages adapted to be loaded on a carrying vehicle such as a truck, which can be used for loading and unloading the truck and then be secured to the rear of this latter to be thus transported. This type of carriage is generally of small size, so as to extend beyond the truck only a small distance, its chassis being so formed that the front wheels will be adjacent the forward end of its load fork.

To this end, the motorized lift trucks of the mentioned type generally comprise a chassis having a forwardly open U shape, provided with two front wheels and a rear steering wheel, such that the lifting means thus extend in their most retracted position between the lateral limbs of the U-shaped chassis.

A general constraint for the design of carriages loaded on trucks is that the carriages must be as light as possible so as not substantially to decrease the useful load of the truck. This is the reason why loaded-on carriages generally do not have counterweights and are designed such that the weight will be disposed between the wheel arms at the rear of the front wheels of the carriage in transport position. However, it is necessary, in order to be able to deposit or take up a load on the truck bed in the case in which the front wheels cannot pass below said bed, to provide supplemental devices to advance the load forks forwardly of the front wheels: in this static loading position, the load being adapted to be raised by a loaded-on truck is substantially equal to the total empty weight of the carriage.

To satisfy the above restrictions, the loaded-on trucks of known type are all in the form of carriages with a vertical double-acting mast: this vertical double-acting mast permits handling and transportation and facilitates also the loading of the carriage on the rear of the truck according to a technique known for example from FR 2 298 454.

The known supplemental devices to displace the forks forwardly of the front wheels in the case of a load forwardly of the front wheels, are of the telescopic fork type, with a fork extension, or a retractable mast.

In the case of telescopic forks, each telescopic fork has a sheath sliding on a support guided by slideways or rollers and driven by a jack in a manner synchronized with the deployment of the other fork. This arrangement has the drawback that the telescopic forks are subjected to rapid wear by friction in contact with the ground and requires maintaining the forks perfectly horizontal when they are in deployed position, because the load will be distanced from the load pier and from the mast platform, and is in danger of sliding abruptly toward the load pier thereby to give rise to undesirable accidents. Moreover, this arrangement involves high production costs and maintenance costs for a relatively low reliability of operation.

In the system with fork extension, a deformable scissors system connects the vertical mast and the platform supporting the forks, while thus displacing the forks horizontally forwardly during deformation of the scissors structure. This system has on the one hand the drawback of increasing the total amount by which the carriage extends rearwardly of the truck, by a distance corresponding to the length of the deformable scissors structure in folded position, which increases the length of the total rolling assembly comprising the carrying vehicle and the loaded-on carriage, and has on the other hand the drawback of diminishing the useful load of the carrying vehicle corresponding to the supplemental weight added by the presence of this deformable scissors structure. Moreover, because the platform supporting the forks is separated from the mast in the re-entry position, the front forks are diverted from the mast by a value corresponding to this spacing, which decreases the capacity of the carriage to bear a load; whilst in static loading position in place, the useful load on the carriage is reduced because of the displacement of the center of gravity resulting from the supplemental weight of the deformable scissors structure, which weight is applied in front of the front wheels.

In the device with retractable masts, the mast is mounted on a structure which slides within the chassis of the carriage. This arrangement has the same drawbacks as the extensible fork system, because of the forward displacement of the assembly comprising the mast and its carrying structure which gives rise to an important forward displacement of the center of gravity of the carriage, which displacement gives rise to a substantial reduction of the load-transporting capacity and of the stability during static loading in place.

In a general manner, all the carriages adapted to be loaded on trucks of the prior art, which is to say carriages with a vertical double-acting mast, have the drawback according to which the mast disposed in front of the driver obstructs his field of view of the load and of the fork located opposite the driver station. These loaded-on carriages of the prior art generally have a small ground contact and are not adapted to travel on broken ground.

It is known, in the field of carriages with a vertical mast which is not contemplated by the present invention, to displace the load-carrying forks laterally to position them in correspondence with the loads to be handled. In particular, the lateral displacement of the forks can be effected with an intermediate platform carrying the forks and moving laterally relative to a principal platform. The lateral displacement of the assembly of the lifting structure comprising a vertical mast carrying one or several platforms can also be effected relative to the carrying chassis by suitable means.

In this known art, effecting lateral displacement of the forks requires emplacing intermediate platforms or large intermediate carrying structures which increase the cost of the lift truck and in particular increase its total loaded weight, such that the useful load of the carriage is decreased per total constant loaded weight, and such that the cost of production of the carriage is increased substantially.

The invention has for its object to overcome the above-mentioned drawbacks of the prior art, by providing a new motorized lift truck adapted to be loaded on the rear of a carrying vehicle in a simple and rapid manner.

The invention also has for its object using the principle of lateral displacement of the carrying structure in the carriage with a telescoping arm, without substantially increasing any mechanical member, whilst permitting use having the same performance as that of the prior art.

The invention has for its object a motorized lift truck, adapted to be loaded on the rear of a carrying vehicle, of the type comprising a chassis of U shape, provided with two front wheels and a rear steered wheel, a driver station and lifting means, characterized in that the lifting means comprise a telescopic arm mounted pivotally under the influence of a lift jack for lifting about a substantially horizontal axis located to the rear of the chassis substantially above said steering wheel.

According to other characteristics of the invention:

the driver station is located to one side of the carriage, the motor propulsion group is located on the side opposite to the driver station and the telescopic arm in its lowered and retracted position corresponding to the carrying of a load passes between the driver station and the motor propulsion group.

the telescopic arm carries at its end remote from the pivotal axis a gripping member orientable by pivoting about a horizontal axis under the action of an actuating jack.

the telescopic arm carries at its end remote from the pivotal axis a platform supporting forks.

the telescopic arm provided with a platform supporting forks is subjected to the action of a compensation jack, so as to maintain the forks horizontal.

the chassis carries retractable stabilizers adapted to come to bear against the ground in front of the points of contact of the front wheels with the ground.

the lifting jack and the compensation jack are mounted on opposite sides of the beam of the telescopic arm.

the carriage comprises locking means of the carriage loaded on the carrying vehicle with a support integral with the carrying vehicle.

said locking means is controlled directly from the driver station of the carriage.

the locking means is controlled upon stopping the carriage motor.

The invention also has for its object a motorized lift truck, with a telescopic arm, comprising a chassis mounted on a plurality of wheels of which at least one is driven, said chassis carrying a motor propulsion group, a cab and lifting means disposed between the motor propulsion group and the cab, said lifting means comprising said telescopic arm mounted pivotably about a substantially horizontal axle, characterized in that the assembly of lifting means comprising the telescopic arm is displaceable transversely, so as to permit precise adjustment over a predetermined distance of the positioning of the lifting means so as to engage the load.

According to other characteristics of the invention:

the telescopic arm is displaceable transversely along its pivotal axle under the action of actuating means disposed adjacent said pivotal axle, said actuating means are hydraulic actuating means comprising at least one hydraulic jack whose direction of action is substantially parallel to the pivotal axle of the telescopic arm, the actuating means are substantially coaxial to the pivotal axle of the telescopic arm, the actuating means are double acting, the actuating means are hydraulic means supplied by openings substantially parallel to or coaxial with the pivotal axle, the actuating means are hydraulic means supplied by openings substantially orthogonal to the pivotal axle.

The invention will be better understood from the description which follows given by way of non-limiting example, with reference to the accompanying drawings, in which.

Figure 1:
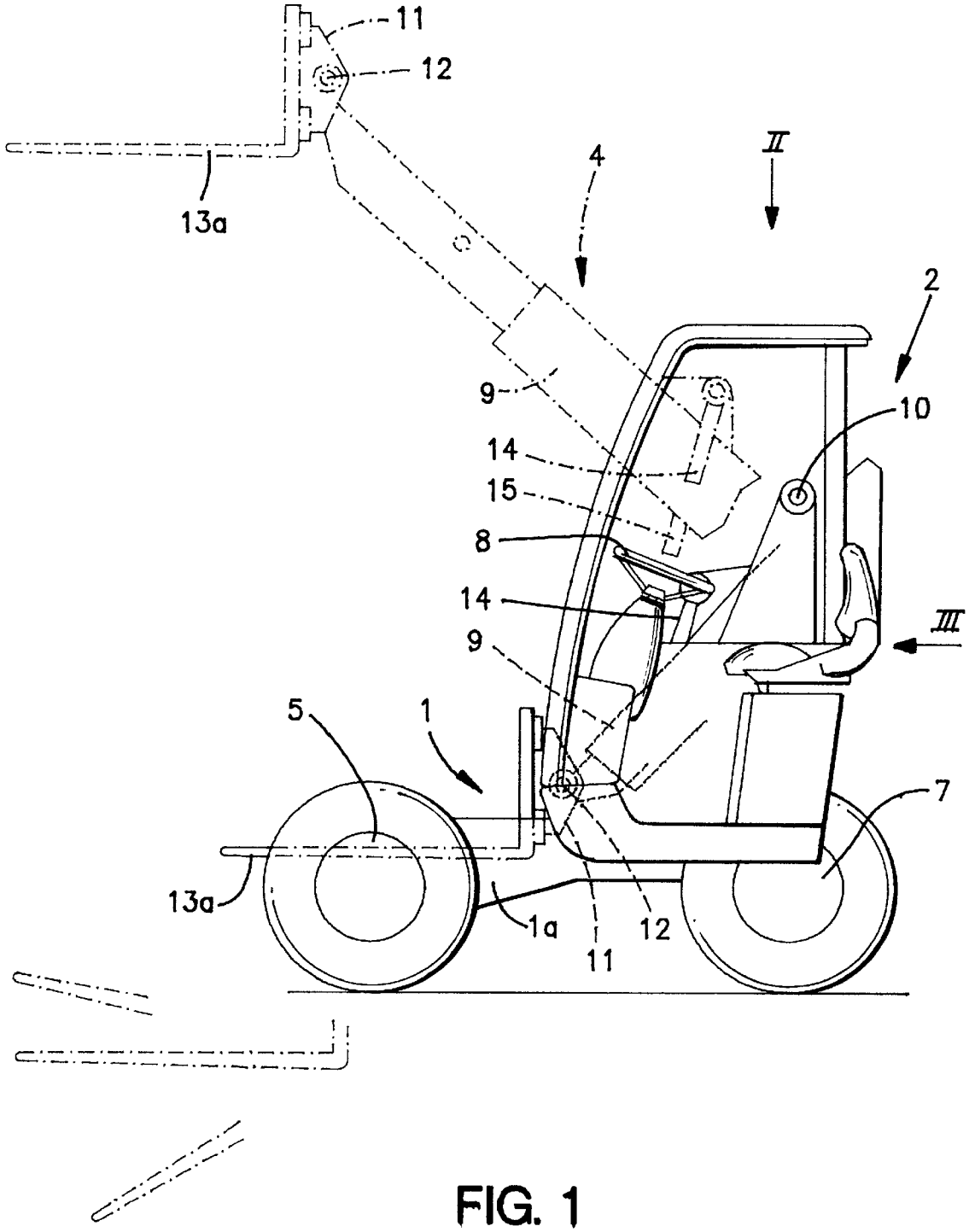
FIG. 1 shows schematically a side elevational view in the direction of the arrow I of FIGS. 2 and 3, of a carriage according to the invention.
Figure 2:
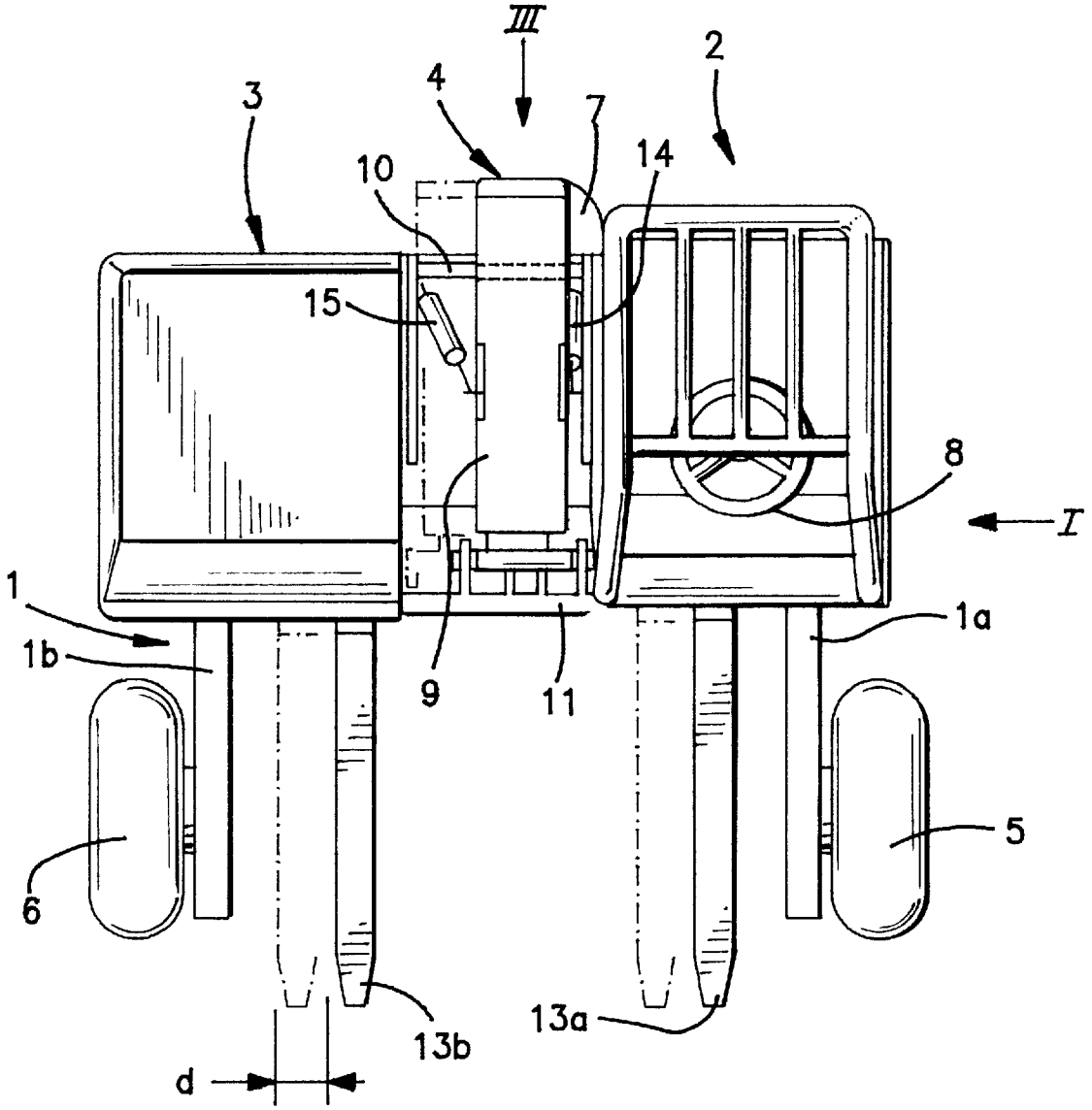
FIG. 2 shows schematically a simplified view from above in the direction of the arrow II of FIGS. 1 and 3, of a carriage according to the invention.
Figure 3:
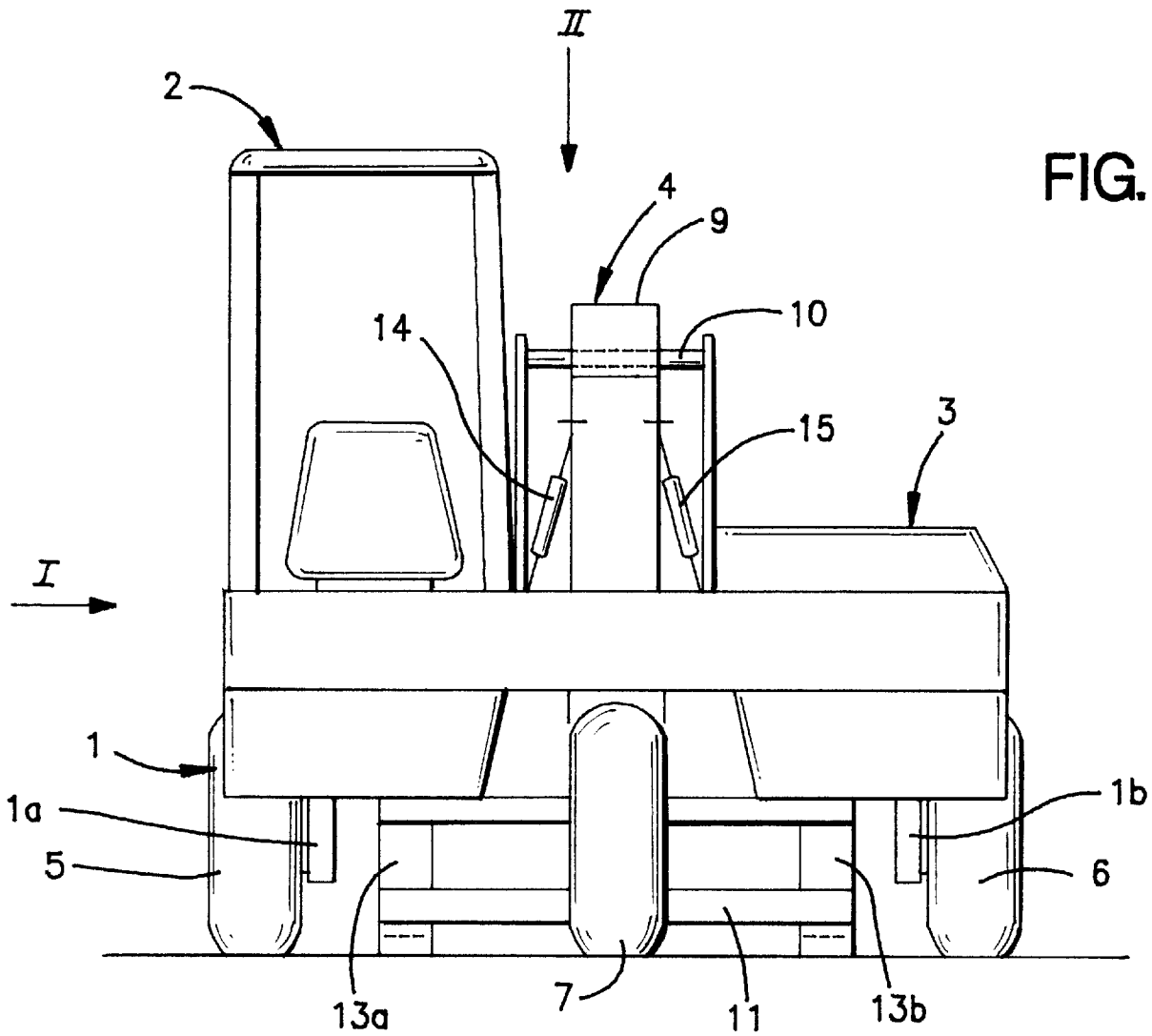
FIG. 3 shows schematically a rear view in the direction of the arrows III of FIGS. 1 and 2, of a carriage according to the invention.

With reference to FIGS. 1–3, in which identical or functionally equivalent elements are given the same reference numerals, a carriage according to the invention comprises a chassis 1 having a forwardly opening U-shaped configuration, a driver station 2, a motor propulsion group 3 and lifting means 4.

One branch 1*a* of the chassis carries a front wheel 5 whilst the other branch 1*b* carries the other front wheel 6. The rear steerable wheel 7 is mounted substantially in the middle of the principal body of the chassis. The rear steerable wheel 7 is controlled by a steering wheel 8 located in the driver station 2 which also comprises all the control members of the lifting means 4.

The motor propulsion group 3 is preferably a group comprising a heat engine driving a hydraulic pump, the necessary distribution and control means being grouped with the motor propulsion group 3 and controlled directly from the driver station 2.

According to the invention, the lifting means 4 comprise a telescopic arm 9 mounted pivotally about a substantially horizontal axle 10 located to the rear of the chassis 1 substantially above the rear steerable wheel 7.

The control and driver station is located on one side of the carriage, the motor propulsion group 3 is located on the opposite side of the control and driver station, and the telescopic arm 9 in its lowered and retracted position corresponding to the transportation of a load, passes between the driver station 2 and the motor propulsion group 3.

This arrangement thus gives excellent visibility of the load and the lifting means 4, contrary to the arrangement of the prior art in which the retractable mast obscured the vision of the operator.

The telescopic arm 9 carries at its end remote from the pivotal axle 10 a gripping member 11 pivotally orientable about a horizontal axis 12 under the action of an actuating jack (not shown and of a type known per se.)

The gripping member 11 is preferably comprised by a platform supporting forks 13*a*, 13*b*. The forks 13*a*, 13*b* can depart from the lowered and retracted position of the telescopic arm 9 corresponding to the transporting of a load and shown in full lines, so as to pass to other horizontal or inclined positions in the direction of storage or a direction of dumping represented in broken lines.

The telescopic arm is extensible under the action of an internal jack (not shown) and pivots under the action of a lifting jack 14 disposed laterally relative to the arm and fixed to a knee piece secured to the beam of the telescopic arm 9.

In the case of carrying a load on broken ground, the carriage according to the invention is preferably provided with a compensation jack adapted to maintain the forks 13*a*, 13*b* horizontal during transport of a load in the case of movement of the carriage over broken ground. Preferably, the lifting jack 14 and the compensation jack 15 are mounted on opposite sides of the beam of the telescopic arm 9, in a position that does not interfere with the vision of the conductor when the telescopic arm 9 is in transport position, entirely lowered and retracted.

Preferably, the assembly of lifting means 4 is displaceable transversely by a predetermined distance d so as to permit precise adjustment of the position of the lifting means during grasping of the load.

Thus, the lifting means 4 comprising the telescopic arm 9 are displaceable along the path d with a movement controlled and directed preferably hydraulically under the action of translation means disposed adjacent the pivotal axle 10.

Preferably, the hydraulic actuating means comprise at least one hydraulic jack, whose direction of action is substantially parallel to the pivotal axle 10.

Figure 4:
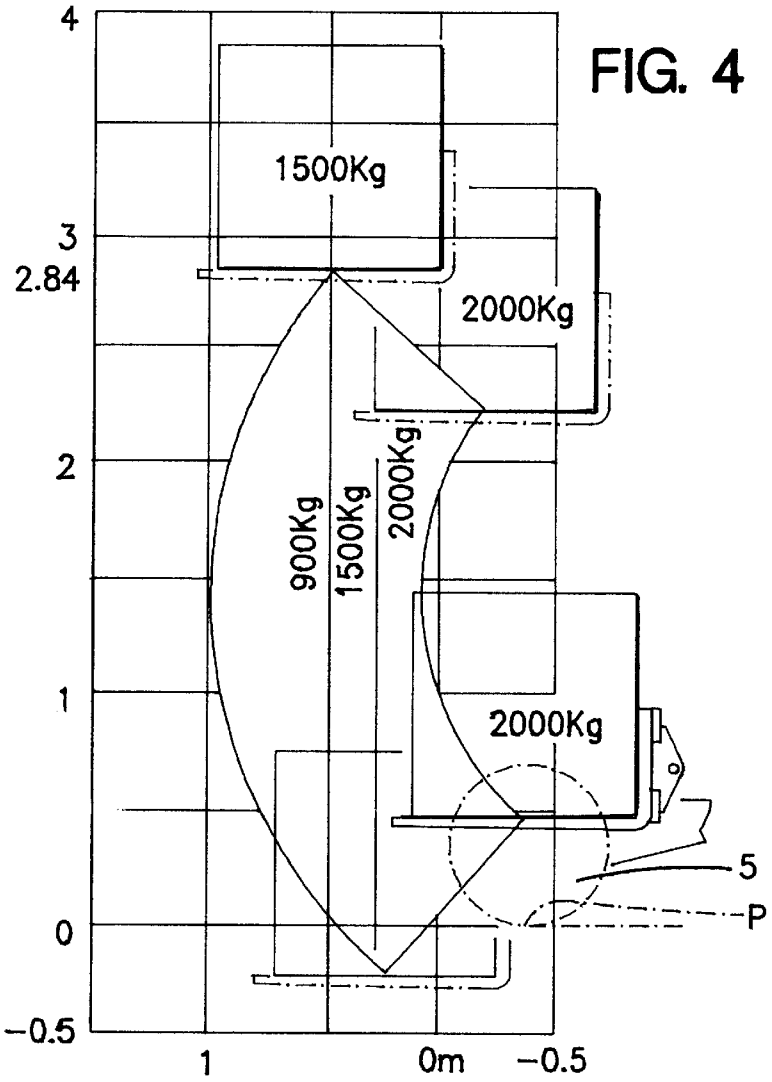

With reference to FIG. 4, a carriage according to the invention has a stability diagram without support, corresponding to raising a load of 9,000 N to a distance of 1 meter in front of the front wheels: there is thus obtained performances equal to or better than those of loaded-on carriages of the prior art. In particular, the carriages according to the invention have a forward projection of the wheels substantially greater than the carriages of the prior art.

Figure 5:
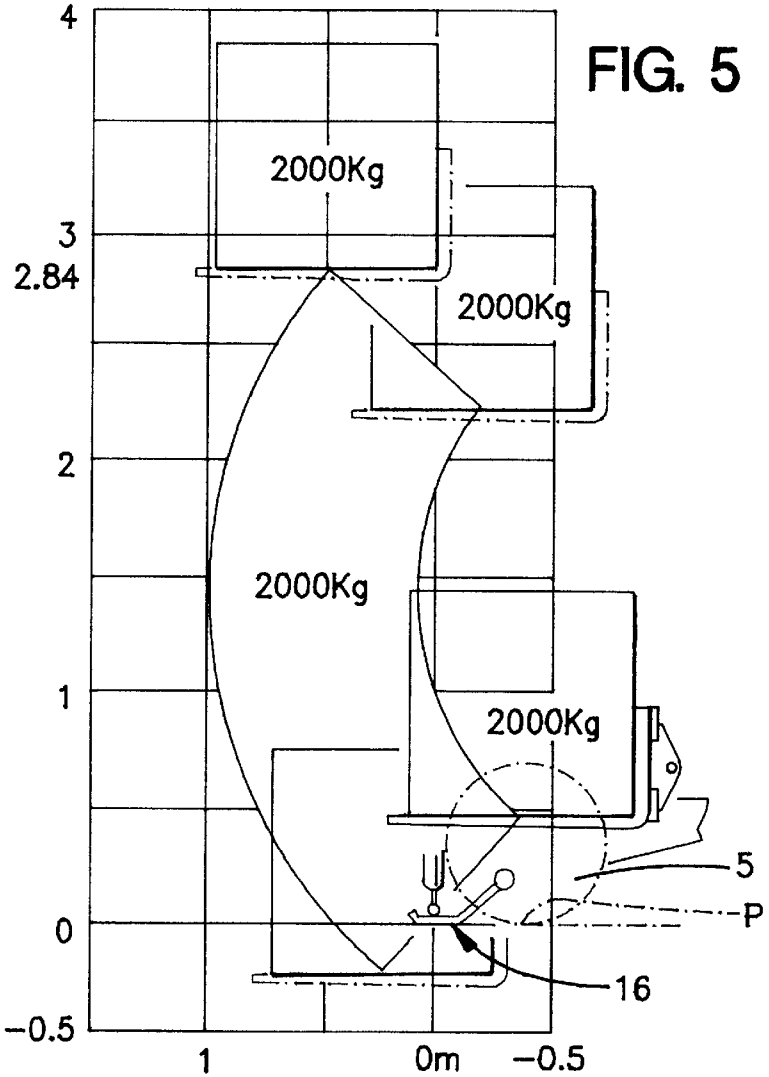
FIGS. 4 and 5 show load diagrams characteristic of a carriage according to the invention.

FIG. 5 is a stability diagram with overhang improved with respect to the diagram of stability without overhang of FIG. 4 and relative to the characteristics of the loaded-on carriages according to the prior art, in the case in which a carriage according to the invention is provided with retractable stabilizers 16 adapted to come into contact with the ground in advance of the point of contact P of a front wheel 5 with the ground.

The retractable stabilizer 16 adapted to come into bearing contact with the ground in front of the points of contact of the front wheels with the ground are fixed on the chassis 1 of the carriage according to the invention in a manner known per se for the securement of stabilizers on loaded-on carriages of the prior art and controlled in an analogous manner by an actuating jack exerting substantially vertical pressure.

Figure 6:
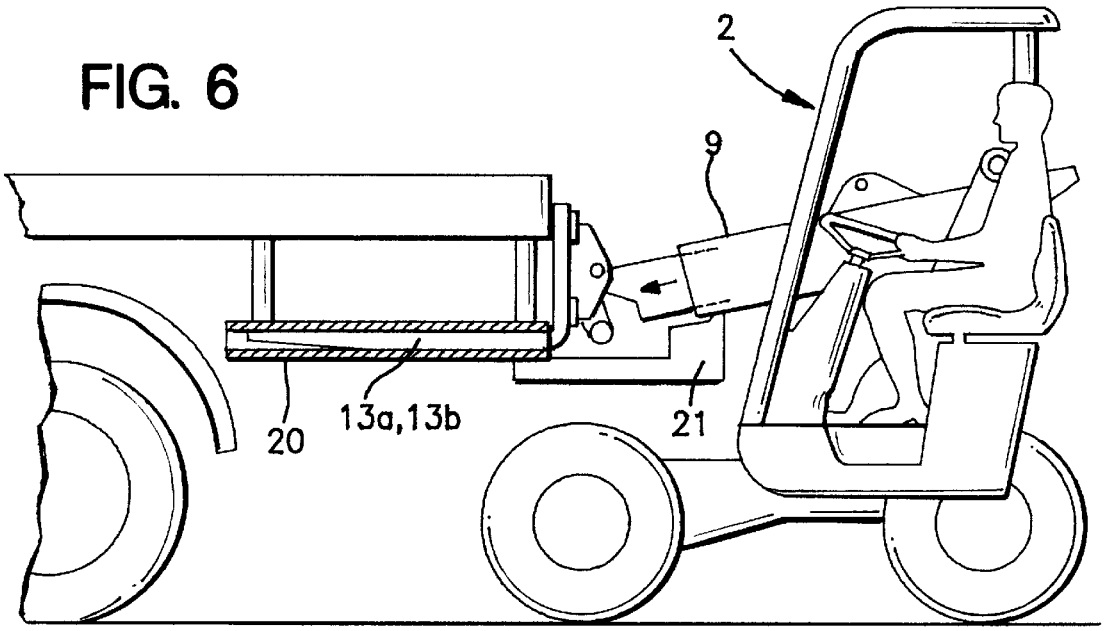
FIGS. 6–8 show schematically the steps of a process of loading a carriage according to the invention on the rear of a carrying vehicle.
Figure 7:
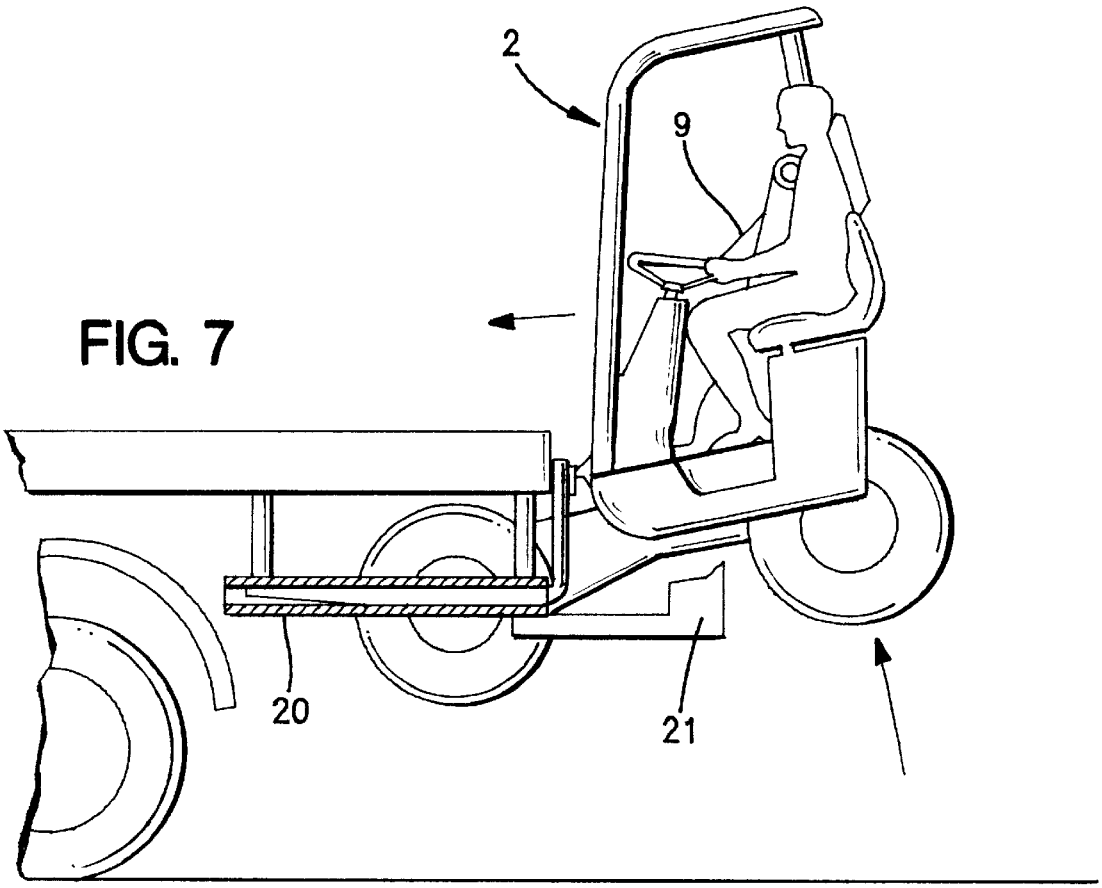
Figure 8:
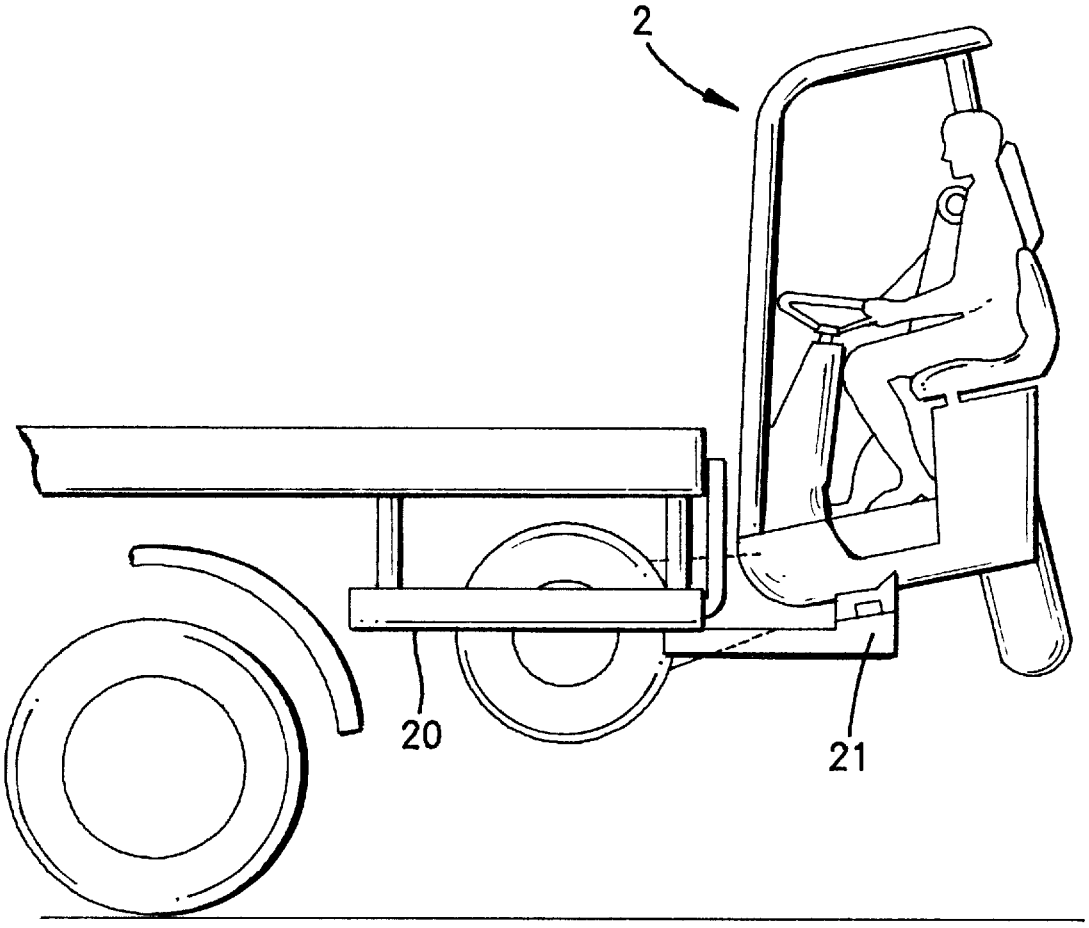

Referring to FIGS. 6–8, a process of loading a carriage according to the invention and of securement to a carrying vehicle comprises the steps described hereinafter.

Referring to FIG. 6, the telescopic arm is extended about 20 cm, so as to slip the forks 13*a*, 13*b* into the slots 20 provided for this purpose and secured to the carrying vehicle beneath the platform of this latter, preferably by rapid securement means of a type known per se. Behind the slots 20, supports 21 are disposed in a predetermined position permitting the passage of the forks 13*a*, 13*b* and of the telescopic arm 9 slightly extended between the supports 21.

After having slid the forks into the slots 20, a combined raising and pivoting movement of the carriage is effected about the telescopic arm 9 to the position shown in FIG. 7 in which the chassis 1 is entirely raised from the ground and slightly inclined forwardly at an angle comprised between 10 and 15 degrees of sexagesimal angles.

From the position of FIG. 7, the telescopic arm 9 is completely retracted, which has the effect of resting the chassis 2 on the support 21. The rear steerable wheel 7 is preferably turned completely to the left or completely to the right, so as to limit the extent of the carriage rearwardly of the vehicle.

The carriage then rests under the effect of its own weight on the support 21 on which it is applied by the telescopic arm in completely retracted position: the equilibrium load position of the machine according to the invention, loaded on the rear of the carrying vehicle, is completely stable and permits transportation over long distances.

Preferably, there is provided a complementary locking means of the loaded-on carriage on the carrying vehicle with the support 21 secured to the carrying vehicle. This locking means could for example comprise two lateral bolts controlled directly by means of a lever disposed in the driving and carriage control station 2. The lateral bolts could be mechanical bolts or hydraulically controlled bolts, or else electrically controlled. In a preferred modification, the locking means is controlled by stopping the carriage motor or interruption of the electrical supply of the carriage, or interruption of the hydraulic supply of the carriage.

The invention described in reference to particular embodiments is not thereby limited but covers on the contrary all modifications of shape and of embodiment in the framework of the spirit of the invention: thus, the motor propulsion group 3 could well be constituted by an electrical group operating on batteries in the case of applications prohibiting the use of heat engines.

Figure 9:
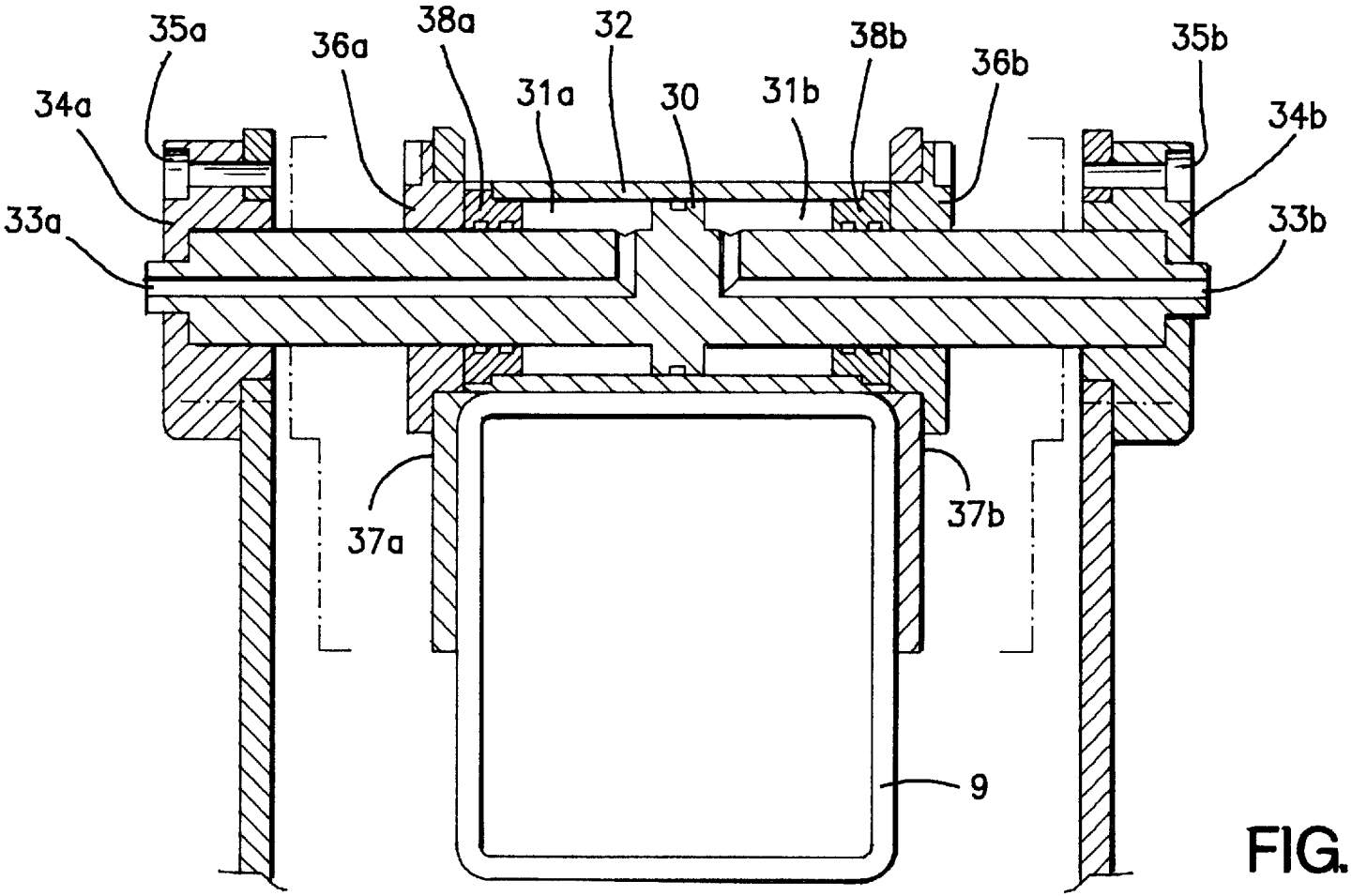
FIG. 9 shows schematically in cross section a fragmentary axial view of a telescopic arm of a lift truck according to the invention.

Referring to FIG. 9, in a first embodiment of the invention, a piston 30 fixed to the pivotal axle 10 of the telescopic arm is schematically shown by its principal beam 9. The piston 30 delimits two chambers 31*a* and 31*b* within a skirt 32. A first perforation 33*a* provided substantially coaxially to the pivotal axle 10 and a second perforation 33*b* provided substantially coaxially to the pivotal axle 10 permit the supply respectively of each chamber 31*a* or 31*b* with hydraulic fluid.

The axle 10 is mounted fixedly to the chassis 1 by means of two mounting members 34*a*, 34*b* assembled on the chassis 1 by screwing, for example with flush screws 35*a*, 35*b*, or by any other means permitting the emplacement of the pivotal axle 10 and the passage of the piston 30 through an opening of a suitable diameter for this purpose.

The skirt 32 is closed at its ends by two closure rings 38*a*, 38*b* carrying suitable sealing joints, the rings 38*a*, 38*b* being secured in a manner known per se by screwing or equivalent means.

The structure thus described has a double rod jack configuration, in which the piston 30 is fixed and the skirt 32 moves in a first direction when the chamber 31*a* is subjected to hydraulic pressure and in a second direction opposite to the first direction when the chamber 31*b* is subjected to hydraulic pressure.

Those skilled in the art can thus easily fix a transverse movement path d as a function of the internal diameters of the skirt 32 and the widths of the piston 30 remaining stationary relative to the pivotal axle 10 and relative to the chassis 1 of the lifting carriage.

Upon movement imposed by the hydraulic pressure introduced into one or the other chamber 31*a* or 31*b*, the skirt 32 bears via one or the other closure ring 38*b* or 38*a* on bearing pins 36*b* or 36*a*. Each bearing pin 36*a* or 36*b* is secured to an angle member 37*a* or 37*b* which is itself connected to the principal beam of the telescopic lifting arm of the carriage according to the invention.

Thus, the invention permits providing in a simple manner a lateral displacement which does not impede the pivoting of the telescopic arm, the lateral displacement means permitting simultaneously the pivoting of the telescopic arm about the substantially horizontal axle 10.

Figure 10:
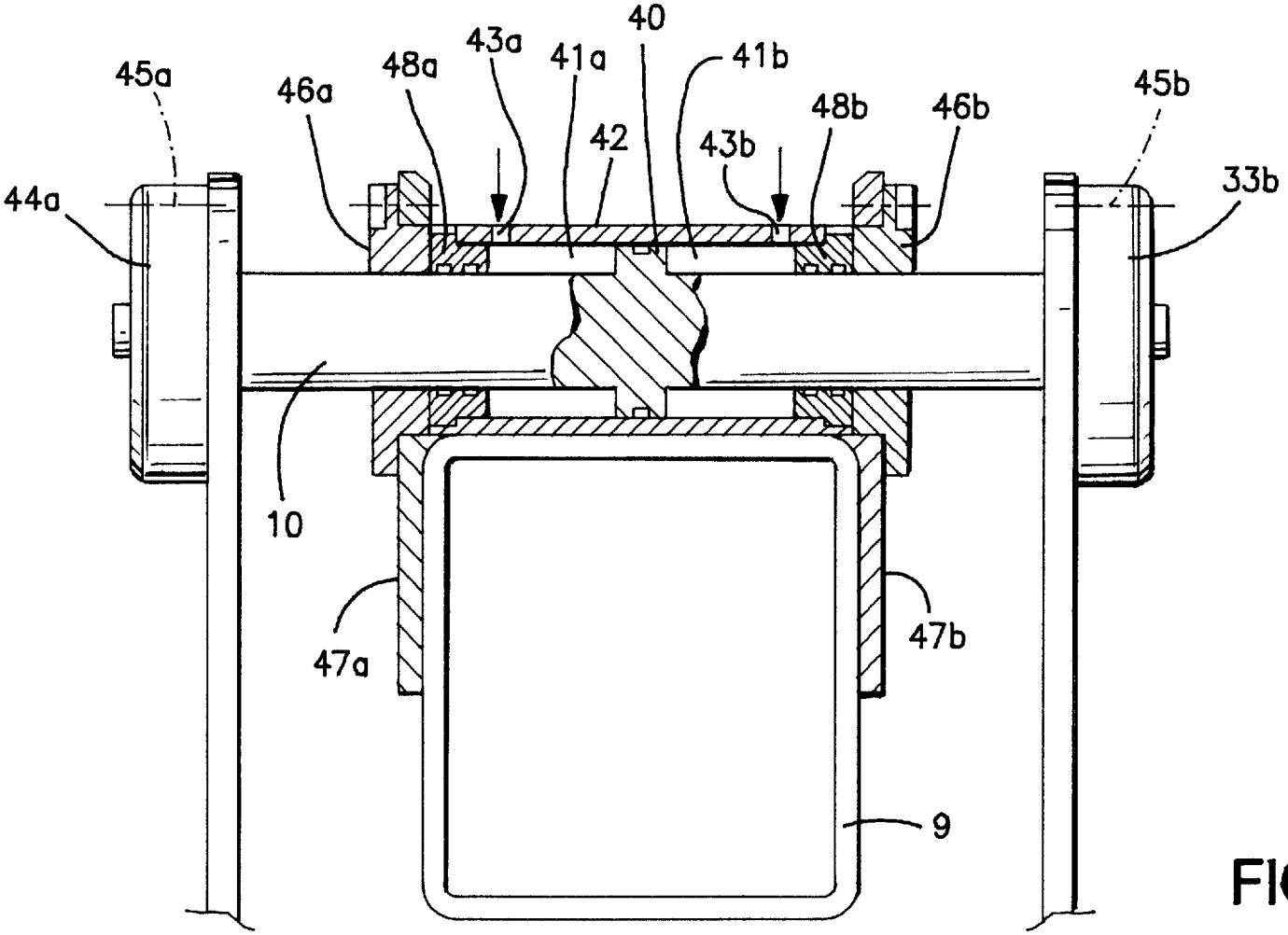
FIG. 10 shows in fragmentary axial cross section another carriage according to the invention.

With reference to FIG. 10, in another embodiment of the invention, a piston 40 is secured to the pivotal axle 10 of the telescopic arm schematically shown by its principal beam 9. The piston 40 delimits two chambers 41*a* and 41*b* within a skirt 42. To avoid piercing openings of reduced diameter and substantial length 33*a*, 33*b* of the embodiment of FIG. 9, there are provided two supply or evacuation openings for hydraulic fluid, 43*a*, 43*b*, directly within the skirt 42. Such tapped orifices 43*a*, 43*b* for supplying hydraulic fluid are of a type known per se and do not require a more detailed description.

The axle 10 is mounted fixedly to the chassis 1 by means of two mounting members 44*a*, 44*b* assembled on the chassis 1 for example by screwing, by flush screws 45*a*, 45*b*, or by any other means permitting the emplacement of the pivotal axle 10 and the passage of the piston 40 through an opening of a diameter suitable for this purpose.

The skirt 42 is closed at its ends by two closure rings 48*a*, 48*b* bearing suitable sealing joints, the rings 48*a*, 48*b* being secured in a manner known per se by screwing or equivalent means.

The structure thus described has the form of a double rod jack, in which the piston 40 is fixed and the skirt 42 moves in a first direction when the chamber 41*a* is subjected to hydraulic pressure and in a second direction opposite to the first direction when the chamber 41*b* is subjected to hydraulic pressure.

Those skilled in the art can thus fix easily a transverse displacement path d as a function of the internal dimensions of the skirt 42 and the width of the piston 40 which remains fixed relative to the pivotal axle 10 and relative to the chassis 1 of the lifting carriage.

During the movement caused by the hydraulic pressure introduced into one or the other chamber 41*a* or 41*b*, the skirt 42 bears via one or the other closure ring 48*b* or 48*a* against the bearing pins 46*b* or 46*a*. Each bearing pin 46*a* or 46*b* is secured to an angle iron 47*a* or 47*b* which is itself connected to the principal beam of the telescopic lifting arm of the carriage according to the invention.

Thus the invention permits effecting in a simple manner a lateral displacement which does not prevent the pivoting of the telescopic arm, the lateral displacement means permitting simultaneously the pivoting of the telescopic arm about the substantially horizontal axle 10.

Although the invention has been described with reference to two particular embodiments it is not thereby limited, but on the contrary covers any modification of shape or any variation of embodiment within the scope and spirit of the invention, particularly any modification in which the pivoting and the transverse displacement can be insured coaxially of the pivotal axle 10.

I claim:

1. In a motorized lift truck, comprising a chassis (1) having a U-shape, said chassis having two branches carrying two front wheels, said chassis carrying a steerable rear wheel (7), a driver station (2), a motor propulsion group (3) and lifting means (4) including a lifting jack (14), said lifting means extending in a retracted position between the branches of the U-shaped chassis in order to be loaded onto the rear of a carrying vehicle;

the improvement wherein the lifting means (4) comprise a telescopic arm (9) pivotally mounted about a substantially horizontal pivot axle (10) located at the rear of the chassis (1) substantially above said rear steerable wheel (7), wherein said telescopic arm (9) is pivotable about said pivot axle (10) under the action of said lifting jack (14), and wherein the driver station (2) is located on one side of the truck, the motor propulsion group (3) is located on another side of the truck opposite the driver station (2) and the telescopic arm (9) in a lowered and retracted position passes between the driver station (2) and the motor propulsion group (3).

2. Truck according to claim 1, wherein the telescopic arm carries at its end remote from the substantially horizontal pivot axle (10) a gripping member (11), and wherein said gripping member (11) is pivotally orientable about a horizontal axis (12).

3. Truck according to claim 1, wherein the chassis (1) has retractable stabilizers (16) adapted to come into contact with the ground in front of contact points of the front wheels (5, 6) with the ground.

4. Truck according to claim 1, wherein the telescopic arm carries at its end remote from the pivotal axle (10) a platform (11) supporting load-lifting forks (13*a*, 13*b*).

5. Truck according to claim 4, wherein the chassis (1) further carries a compensation jack (15) for acting on the telescopic arm (9) to maintain the forks (13*a*, 13*b*) in a horizontal position.

6. Truck according to claim 5, wherein the lifting jack (14) and the compensation jack (15) are mounted on opposite sides of the telescopic arm (9).

7. In a motorized lift truck with a telescopic arm, comprising a chassis mounted on a plurality of wheels of which at least one is power driven, said chassis carrying a motor propulsion group and a cab and lifting means disposed between the motor propulsion group and the cab, said lifting means comprising said telescopic arm, said telescopic arm being pivotally mounted about a substantially horizontal axle; the improvement wherein the lifting means comprising the telescopic arm is displaceable transversely along said substantially horizontal axle under the action of actuating means disposed adjacent said horizontal axle, so as to permit precise adjustment along a predetermined distance (d) of the transverse position of the lifting means so as to engage a load.

8. Truck according to claim 7, characterized in that said actuating means are hydraulic actuating means comprising at least one hydraulic jack whose direction of action is substantially parallel to the horizontal axle (10) of the telescopic arm (9).

9. Truck according to claim 7, wherein the actuating means are substantially coaxial with the horizontal axle (10) of the telescopic arm (9).

10. Truck according to claim 7, wherein the actuating means are double acting.

11. Truck according to claim 7, wherein the actuating means are hydraulic means supplied by openings substantially parallel to or coaxial with the horizontal axle (10).

12. Truck according to claim 7, wherein the actuating means are hydraulic means supplied by openings substantially orthogonal to the horizontal axle (10).

* * * * *